United States Patent [19]

Ketkar

[11] 4,397,656

[45] Aug. 9, 1983

[54] PROCESS FOR THE COMBINED COKING AND GASIFICATION OF COAL

[75] Inventor: Anil B. Ketkar, Trenton, N.J.

[73] Assignee: Mobil Oil Corporation, New York, N.Y.

[21] Appl. No.: 344,568

[22] Filed: Feb. 1, 1982

[51] Int. Cl.[3] ..... C10J 3/00

[52] U.S. Cl. ..... 48/202; 48/203; 48/210; 252/373

[58] Field of Search ..... 48/202, 203, 206, 210; 252/373

[56] References Cited

U.S. PATENT DOCUMENTS

| | | | |
|---|---|---|---|
| 3,694,346 | 9/1972 | Blaser et al. | 201/44 |
| 3,702,516 | 11/1972 | Luckenbach | 201/31 |
| 3,847,563 | 11/1974 | Archer et al. | 48/77 |
| 3,876,392 | 4/1975 | Kalina et al. | 48/202 |
| 4,032,305 | 6/1977 | Squires | 48/73 |
| 4,069,304 | 1/1978 | Starkovich | 48/202 |
| 4,269,696 | 5/1981 | Metrailer | 208/120 |

*Primary Examiner*—Robert L. Lindsay, Jr.

*Attorney, Agent, or Firm*—Charles A. Huggett; Michael G. Gilman; Charles J. Speciale

[57] ABSTRACT

A combined gasification/devolatilization process for coal in coal residues is disclosed wherein hydrogen rich volatiles are recovered prior to gasification of the coal. The recovery of hydrogen volatiles is dependent upon the rapid heating of coal obtained by admixture with hot char previously gasified in a riser with steam and a catalyst if necessary. The hot char is provided by combustion of devolatilized coal in a fluid bed regenerator. Alternative systems are provided for purifying the devolatilized coal prior to its charring.

8 Claims, 2 Drawing Figures

PROCESS FOR THE COMBINED COKING AND GASIFICATION OF COAL

BACKGROUND OF THE INVENTION

This invention relates to the field of gasification of coal, and, specifically, provides a process for the combined devolatilization and gasification of coal or coal residues or mixtures of coal and petroleum residual oils. As available fuel sources become increasingly limited, and the price of fuel soars, the gasification of coal becomes an increasingly attractive and important process by which additional fuel sources may be liberated. Although much experimentation has been performed in this field, the developed processes suffer from a number of drawbacks or defects. Among the problems encountered are the relatively high cost of providing sufficient heat to achieve the high temperatures (above 2,000° F.) necessary to achieve gasification, the low $H_2$:CO ratio for the synthesis gas product, the presence of tars and volatiles in the synthesis gas recovered, and the need to employ pure oxygen as an oxidizing medium.

The inventor has discovered that the need for high temperature and the use of pure oxygen can be avoided with resultant savings by an integrated coal devolatilization/gasification process such that the recycling of waste products can provide a heat carrier. The desired products can thereby be secured in large yields while the need for oxygen and the excessive loss of thermal energy are avoided.

U.S. patents describing prior art processes include U.S. Pat. Nos. 3,694,346, 3,702,516, 3,726,791 and 4,269,696. Each of these patents, and others in the field, requires the use of oxygen and encounters high thermal penalties which make the overall process far less efficient and less economically desirable.

Accordingly, it is one object of the present invention to provide a coal gasification process which avoids the need for the use of pure oxygen.

Another object of this invention is to provide a coal gasification process which enjoys a low thermal penalty by employing recycled and waste products as heat carriers.

A third object of this invention is the recovery of hydrogen rich volatiles and the preparation of a non-agglomerating char through coal devolatilization at an economically attractive cost.

A further object of this invention is to avoid the mixing of the products of coal devolatilization (tars, volatiles and pyrolysis off-gas) with the synthesis gas produced by char gasification in the riser-gasifier, thereby improving the efficiency and operability of subsequent heat recovery equipment on the synthesis gas product.

Another object of this invention is to minimize the carbon losses with the outgoing char, thereby maximizing gasification efficiency.

BRIEF DESCRIPTION OF THE DRAWINGS

The above summary and discussion, as well as further objects, features and advantages of the present invention will be more fully appreciated by reference to the following detailed description considered together with the accompanying drawings, FIG. 1 of which is a schematic representation of the process disclosed below.

SUMMARY OF THE INVENTION

Figure 1:
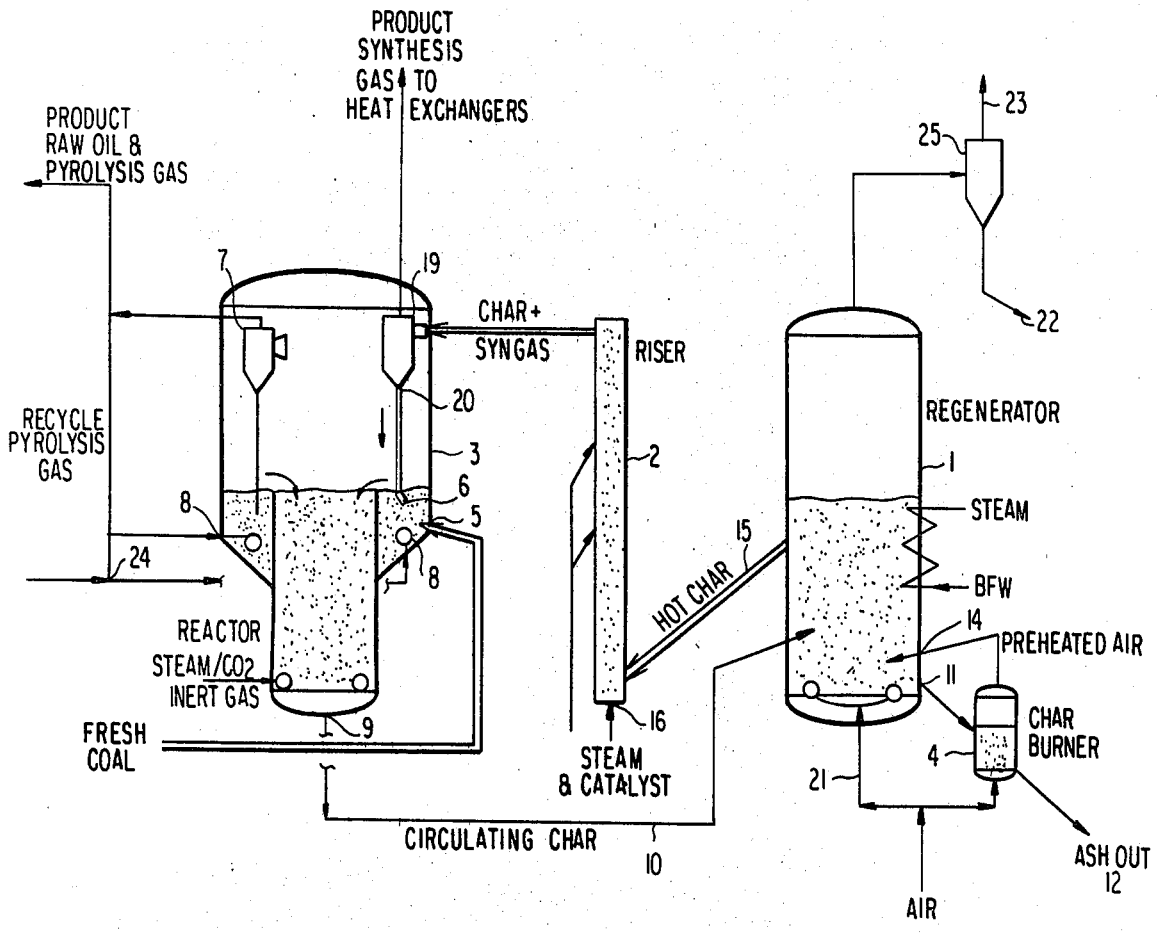

A combined coal devolatilization/gasification fluid process for the recovery of hydrogen rich volatiles depends on the recovery of those volatiles prior to gasification in a fluid bed. The bed is to be fluidized by the recycling of gases produced by coal devolatilization. Additional fluidizing gases such as steam, $CO_2$ or other non-oxidizing gases may also be used in conjunction with the recycle gases. The heat for such devolatilization or coking of coal is obtained from a hot (about 1,000° to about 1,600° F.) char stream remaining after the gasification of carbon in the char in a riser gasifier. This gasification takes place in a riser with steam after the char has been heated in a regenerator. The gasification may take place in the presence of a catalyst if such is necessary to lower the gasification temperature and/or to reduce the riser gasifier size.

DETAILED DESCRIPTION OF THE INVENTION

The inventor has discovered a combined coal devolatilization/gasification process which provides good yields of hydrogen rich volatiles to be converted into useful fuel products while avoiding the need to use pure oxygen and permitting operation of the entire system at relatively lower temperatures. Recovery of the hydrogen rich volatiles takes place prior to gasification in a fluid bed. The bed is fluidized by recycling off gases produced by coal devolatilization with or without additional fuidizing gases such as steam, $CO_2$ or other non-oxidizing gases, the heat for which is provided by a hot char stream remaining after the gasification of char in a riser gasifier, much like an FCC riser reactor. It is the direct and rapid mixing of the hot char with fresh coal in the fluid bed in presence of hydrogen rich recycle gases, that is believed to give the improved yield of volatile products.

The process is operated on a continuous, cyclical basis and is initiated by heating devolatilized coal in a regenerator 1 by partial combustion with air in a fluidized bed, and circulating the hot char (preferably at a temperature of about 1,200° to about 1,800° F.) to a riser 2. In the riser, the carbon present in the char is partially gasified with steam to produce synthesis gas, which is separated off from the hot char (now at a temperature of about 1,000° F. to about 1,600° F.) in riser cyclones of the type employed in an FCC riser reactor. The synthesis gas is sent to heat recovery systems and is then subjected to further processing. The hot char is separated off and admixed with the fresh coal in a fluid bed reactor 3 to produce devolatilized coal, gas, and volatiles. The gas is sepearated off from the volatiles and water which are produced, and all, or a portion of the gas is then compressed and recycled back as the fluidizing gas for the devolatilization reactor 3, with or without additional fluidizing gases such as steam, $CO_2$ or other non-oxidizing gases 24. The devolatilized coal or char is then circulated to the regenerator 1, where it is again heated, and thereafter passed to gasification.

It can therefore be seen that, in the instant process, the hydrogen rich volatiles are obtained prior to gasification in the riser 2, through the direct admixture of hot char with the fresh coal, thereby giving an improved yield. The ratio of the hot char to fresh coal must be maintained above 1:1 to prevent agglomeration of certain coals. Preferably, this ratio is maintained in the range of about 5:1 to about 20:1.

It is important in the gasification step to maintain relatively lower temperatures of about 1,000° F. to about 1,600° F. in order to minimize heat losses and improve thermal efficiency. High rank coals such as bituminous or anthracite coals may require a catalyst in order to secure low gasification temperatures. Such catalysts include gaseous $SO_2$, $SO_2$ generating compounds like alkali metal sulfite or bisulfite, an alkaline earth sulfite or bisulfite, waste $CaSO_3$ sludge, lime, limestone or dolomite. These catalysts can be introduced at the bottom of the gasification riser and/or at intermediate points along the riser. Introduction of the catalysts at intermediate points will further enhance the gasification rate of the hot char carbon. The catalyst, if solid, may be introduced at any other point in the solids circulation loop.

Figure 2:
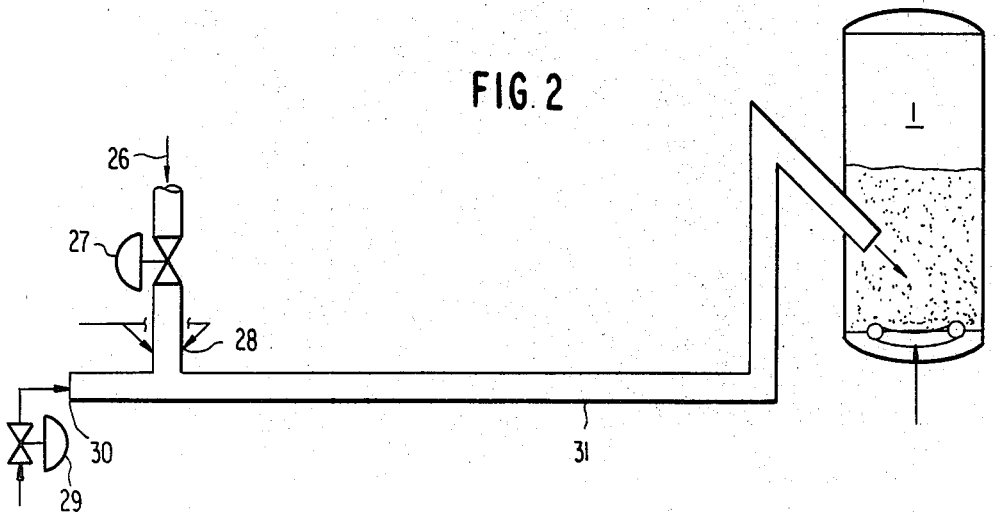
FIG. 2 is a schematic representation of an alternative embodiment of the process disclosed below, employing a burner pipe.

As described above, the devolatilized coal is recovered to be used as the hot char for gasification. Frequently, this devolatilized coal will be contaminated or mixed with inorganic solids, the catalysts, if present, and ash. These impurities can be removed by one of two methods or their suitable combination:

(1) the devolatilization residues preferably char fines from the reactor cyclones are fed to a burner pipe fed with air shown in FIG. 2. The residues are fed through a valve 27 into a short length of pipe which is continuously or periodically purged with an inert gas, $CO_2$, or steam 28. The residues pass from there into burner pipe 31.

Heated air is fed through valve 29 into burner pipe 31 at 30. The rate of flow is sufficient to maintain the velocity in the burner pipe at between about 5 and 50 ft./sec. The air to residues ratio is maintained such that there is always an excess of air relative to the total combustible content of the char. The char is burned throughout burner pipe 31, which is long enough to ensure essentially complete combustion of the carbon values in the residues, and then fed to the regenerator 1. The residues are burnt essentially completely to produce fly ash in the burner pipe and to increase the air temperature to about 600° F. to about 1,600° F. This preheated air is then used as part of the fluidizing gas for the regenerator vessel 1 wherein the hot char is produced. The fly ash produced by combustion is then taken out of the system by regenerator cyclones; or (2) a slip stream of char will be taken from the bottom of the char regenerator and sent to a fluidized char burner 4. Air is preheated in the char burner by combustion of carbon values in the char and sent on to the regenerator. The ash remaining in the char burner is withdrawn continuously.

The continuous cycle can be further understood by means of tracing the path followed by freshly introduced coal and the products derived. The coal enters the devolatilization reactor at point 5. Within the reactor, the coal is devolatilized through admixture with hot char transferred from the gasification riser 2 at 6.

Upon devolatilization, the released volatiles and pyrolysis gas are drawn off along with water vapor at 7. Volatiles and water vapor are condensed and removed. The gas is compressed and recycled to be used as fluidizing gas at 8 with or without additional fluidizing gas such as steam, $CO_2$, etc.

The devolatilized coal or char is drawn off from the reactor 3 at 9 and transferred at 10 to the regenerator 1. The impurities can be removed by either passing char residues to a burner pipe fed with air, as described, or by removing a slipstream of char from the bottom 11 of the regenerator 1 and passing it to the char burner 4. The carbon values in the char are burnt to preheat the excess air in the burner, leaving only ash and solid catalyst, if any, as residue. Ash is removed 12 and the preheated air 14 from char burner 4 is sent to the regenerator 1 together with products of combustion of the carbon values.

The preheated air 14 and the fluidizing air 21 to the regenerator 1, together provide sufficient oxygen to only partially burn the char in the regenerator and to maintain its temperature at the desired level in the regenerator. Waste products are drawn off and sent to regenerator cyclones 25, wherein flue gas is removed 23 and flyash taken out of the system 22.

Upon heating to about 1,200° F.–1,800° F., the hot char is circulated to the gasification riser 2. Steam, and a catalyst(s) if necessary, are also introduced to the riser 2, at the bottom 16 and intermediate points 17 and 18 along the riser 2. After gasification, the product synthesis gas, which is essentially free of tars and volatiles, is taken off 19 and sent to heat recovery systems and further processing. Efficient heat recovery on this gas is made possible by the absence of tars and volatiles. It is also possible, by this method, to easily avoid downstream deposits in further processing of synthesis gas. The hot char that is separated off 20 is admixed with fresh coal at 6, thereby completing one full cycle of the process of this invention.

It will be noted that the pyrolysis gas produced in the devolatilization reactor is recycled to fluidize the bed of the reactor, which allows the recovery of hydrogen rich volatiles. Similarly, the air used to remove ash from the devolatilized coal is recycled to the char regenerator. Although it will be apparent to those of ordinary skill in the art that additional sources could be introduced for those gases, the described system achieves the most economical recovery of fuel products.

As indicated, the precise processes described above are merely representative of the range of processes and embodiments which could be used in practicing this invention. It is to be understood therefore that specifically mentioned apparatus and materials are illustrative only, and that any changes made, especially as to matters of shape, size and arrangement, to the full extent extended by the general meaning of the terms in which the appended claims are expressed, are within the principle of the invention.

I claim:

1. A continuous process for the combined devolatilization and gasification of coal comprising the steps of (a) heating devolatilized coal by partial combustion with air in a fluid bed to produce carbon-containing hot char, (b) circulating said hot char to a carbon in said hot char with steam to produce synthesis gas and thereafter separating said synthesis gas and said hot char, (d) rapidly mixing said separated hot char with fresh coal in a ratio of 1:1 or greater in a devolatilization fluid bed reactor to recover devolatilized coal, gas and volatiles, (e) separating ash and impurities from said recovered devolatilized coal by burning, and (f) recycling said purified devolatilized coal for heating to produce hot char.

2. A continuous process for the combined devolatilization and gasification of coal comprising the steps of (a) heating devolatilized coal by partial combustion air in a fluid bed to produce carbon-containing hot char, (b) circulating said hot char to a gasification riser, (c) in said riser, gasifying the carbon in said hot char with steam to produce synthesis gas and thereafter separating said synthesis gas and said hot char, (d) rapidly mixing said separated hot char with fresh coal in a ratio of about 5:1 to about 20:1 in a devolatilization fluid bed reactor to recover devolatilized coal, gas and volatiles, (e) separating ash and impurities from said recovered devolatilized coal by burning, and (f) recycling said purified devolatilized coal for heating to produce hot char.

3. A continuous process for the combined devolatilization and gasification of coal comprising the steps of (a) heating devolatilized coal by partial combustion with air in a fluid bed to produce carbon-containing but char, (b) circulating said hot char to a gasification riser, (c) in said riser, gasifying siad hot char with steam and a catalyst selected from the group consisting of gaseous $SO_2$, an $SO_2$ generating compound, waste $CaSO_3$ sludge, lime, limestone and dolomite to produce synthesis gas, and thereafter separating said synthesis gas and said hot char, (d) rapidly mixing said separated hot char with fresh coal in a ratio of 1:1 or greater in a devolatilization fluid bed reactor to recover devolatilized coal, gas and volatiles, (e) separating ash and impurities from said recovered devolatilized coal by burning, and (f) recycling said purified devolatilized coal for heating to produce hot char.

4. A continuous process for the combined devolatilization and gasification of coal comprising the steps of (a) heating devolatilized coal by partial combustion with air in a fluid bed to produce carbon-containing hot char, (b) circulating said hot char to a gasification riser, (c) in said riser, gasifying said hot char with steam and a catalyst selected from the group consisting of gaseous $SO_2$, an $SO_2$ generating compound, waste $CaSO_3$ sludge, lime, limestone and dolomite to produce synthesis gas, and thereafter separating said synthesis gas and said hot char, (d) rapidly mixing said separated hot char with fresh coal in a ratio of 5:1 to about 20:1 in a devolatilization fluid bed reactor to recover devolatilized coal, gas and volatiles, (e) separating ash and impurities from said recovered devolatilized coal by burning, and (f) recycling said purified devolatilized coal for heating to produce hot char.

5. The process of claims 1, 2, 3 or 4 wherein said step of separating out ash and impurities comprises, (a) feeding said devolatilized coal and impurities and ash into a burner pipe supplied with excess air, (b) burning the material fed in essentially completely to produce fly ash and increase the temperature of the supplied air to about 600° F. to about 1,600° F., (c) removing said fly ash by cyclones and (d) recycling said heated said air into said fluid bed regenerator to act fully or partially as fluidizing gas.

6. The process of claims 1, 2, 3 or 4, wherein said step of separating out ash and impurities comprises (a) taking a slip stream of char from the bottom of said fluid bed regenerator, (b) sending said slip stream to a fluidized char burner wherein it is burnt in air present in excess of the amount required for complete carbon combustion and wherein the excess air is heated by said combustion, (c) recycling said heated air to said fluid bed regenerator to act as air, for partial combustion of said regenerator char, and (d) continuously drawing off ash remaining in the char burner.

7. The process of claims 1, 2, 3 or 4, wherein said step of heating devolatilized coal raises the temperature of the coal to about 1,200° F. to about 1,800° F. and the temperature of said hot char upon gasification is about 1,000° F. to about 1,600° F.

8. The process of claims 1, 2, 3 or 4, wherein said synthesis gas is subjected to further processing separately from further processing or recycling of the gas and volatiles recovered in the fluid bed reactor.

* * * * *

UNITED STATES PATENT AND TRADEMARK OFFICE

CERTIFICATE OF CORRECTION

PATENT NO. : 4,397,656

DATED : August 9, 1983

INVENTOR(S) : Anil B. Ketkar

It is certified that error appears in the above-identified patent and that said Letters Patent are hereby corrected as shown below:

Column 2, line 34, "fuidizing" should be --fluidizing--.

Column 2, line 56, "sepearated" should be --separated--.

Column 5, line 18, "siad" should be --said--.

Column 5, line 16, "but" should be --hot--.

Column 4, line 56, after "a" should be --gasification riser, (c) in said riser, gasifying the --.

Signed and Sealed this

Sixth Day of March 1984

[SEAL]

*Attest:*

GERALD J. MOSSINGHOFF

*Attesting Officer*

*Commissioner of Patents and Trademarks*